United States Patent [19]

Schoemer

[11] 4,117,279

[45] Sep. 26, 1978

[54] MODULAR PUSHBUTTON KEYSET ASSEMBLY

[75] Inventor: Hans Louis Schoemer, Schaumburg, Ill.

[73] Assignee: Motorola, Inc., Schaumburg, Ill.

[21] Appl. No.: 799,054

[22] Filed: May 20, 1977

[51] Int. Cl.[2] ..... H01H 9/04; H01H 9/08

[52] U.S. Cl. ..... 200/5 A; 200/314; 200/302

[58] Field of Search ..... 267/104; 200/302, 5 A, 200/159

[56] References Cited

U.S. PATENT DOCUMENTS

| | | | |
|---|---|---|---|
| 1,707,439 | 4/1929 | Kivlan | 267/104 |
| 3,506,795 | 4/1970 | Schmidt | 200/159 R |
| 3,660,626 | 5/1972 | Kawamura et al. | 200/302 |
| 3,879,586 | 4/1975 | DuRocher et al. | 200/5 A |
| 3,959,610 | 5/1976 | Finnegan et al. | 200/5 A |
| 4,018,999 | 4/1977 | Robinson et al. | 200/5 A |

*Primary Examiner*—J. V. Truhe
*Assistant Examiner*—J. H. Bouchard
*Attorney, Agent, or Firm*—James W. Gillman; Rolland R. Hackbart

[57] ABSTRACT

A modular pushbutton keyset assembly includes a housing, a circuit board, a flat element and a pushbutton keyset held together by a clip. The circuit board includes a pair of contacts for each of the plurality of pushbutton keys. The flat element includes a plurality of resilient popples which have raised portions disposed to support corresponding ones of the plurality of pushbutton keys. The underside of each of the resilient popples is conductive, and when a pushbutton is depressed, the respective conductive underside contacts the corresponding electrical contact pair, thereby providing continuity therebetween.

3 Claims, 7 Drawing Figures

MODULAR PUSHBUTTON KEYSET ASSEMBLY

BACKGROUND OF THE INVENTION

1. Field of the Invention

This invention relates to a modular pushbutton keyset assembly, and more particularly, to an improved modular pushbutton keyset assembly.

2. Description of the Prior Art

Prior art pushbutton keysets usually have a number of posts which project from a housing and pass through a bottom plate and then are heat staked to hold the housing and bottom plate together. Such a keyset cannot be readily disassembled without destruction of the posts. There are other types of pushbutton keysets that are assembled with an adhesive, such as glue, which cements the entire assembly together. Again such keysets cannot be readily disassembled without destroying the keyset. The foregoing problem has been solved to some degree by utilizing threaded posts and nuts to hold the keyset together. A large number of such threaded posts and nuts are required to hold such a keyset together. Thus, such a keyset assembly is complex and costly. In addition, the labor involved in the assembly of such a keyset is relatively time consuming.

None of the prior art keysets provides a pushbutton keyset that can be simply and easily assembled and disassembled.

SUMMARY OF THE INVENTION

Accordingly, it is an object of the present invention to provide an improved modular pushbutton keyset assembly.

It is a further object of the present invention to provide an improved modular pushbutton keyset assembly that is easily assembled and disassembled.

In accordance with the present invention, the aforementioned problems and shortcomings of the prior art are overcome and the aforementioned and other objects are attained by an improved modular pushbutton keyset assembly.

Such a modular pushbutton keyset assembly includes a plurality of pushbutton keys, a flat element, a circuit board, a housing and a clip which has a hooked first end and an inwardly bent second end. The clip provides a spring force to hold together the housing, the circuit board, the flat element and the pushbutton keys. The flat element includes a plurality of resilient popples having raised portions disposed to support corresponding ones of the pushbutton keys. Each of the popples has a conductive underside. The circuit board includes an electrical contact pair for each of the pushbutton keys. Depressing a pushbutton key causes the conductive underside of the respective popple to provide electrical continuity between the corresponding electrical contact pair on the circuit board. Each of the elements of the modular pushbutton keyset assembly can be quickly and easily placed into the housing and secured together by a clip. The modular pushbutton keyset assembly can be disassembled and reassembled as many times as desired without damaging or destroying any of the constituent elements.

Additional features, objects, and advantages of the modular pushbutton keyset assembly in accordance with the present invention will be more clearly apprehended from the following detailed description together with the accompanying drawings.

DETAILED DESCRIPTION OF THE PREFERRED EMBODIMENT

Figure 1:
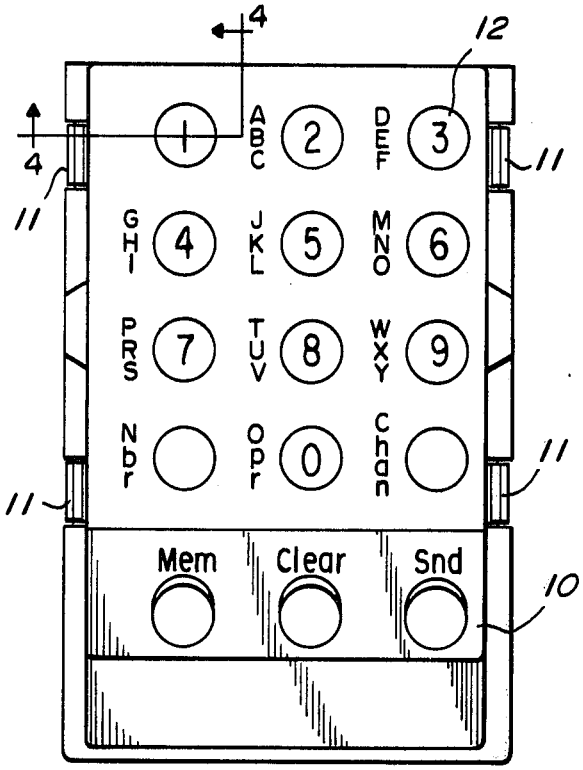
FIG. 1 shows a modular pushbutton keyset assembly of the present invention.

Referring now to FIG. 1 of the drawings, a top view of a modular pushbutton keyset assembly according to the present invention is shown. The assembly includes a housing 10, a plurality of pushbutton keys 12 and clips 11. The preferred embodiment is shown with fifteen pushbutton keys, although any number of pushbutton keys can be used in practicing the present invention. Similarly, at least one clip 11 is required to hold the elements of the assembly together, even though four clips are used in the preferred embodiment. The modular assembly can provide any configuration of pushbutton keys and any desired labelling on the pushbutton keys. If it is desired to change the labelling of a pushbutton key, the modular pushbutton keyset assembly is easily taken apart and the appropriate key can then be changed. Similarly, the circuit board or the flat element with the popples can be readily removed and replaced. The preferred embodiment of the modular pushbutton keyset assembly shown in FIG. 1 is utilized in the handset of a telephone set.

Figure 2:
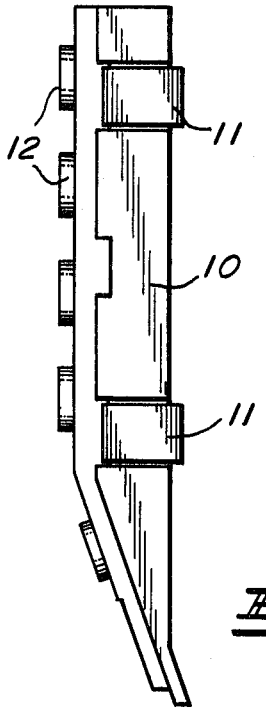
FIG. 2 shows a side view of the modular pushbutton keyset assembly of FIG. 1.
Figure 3:
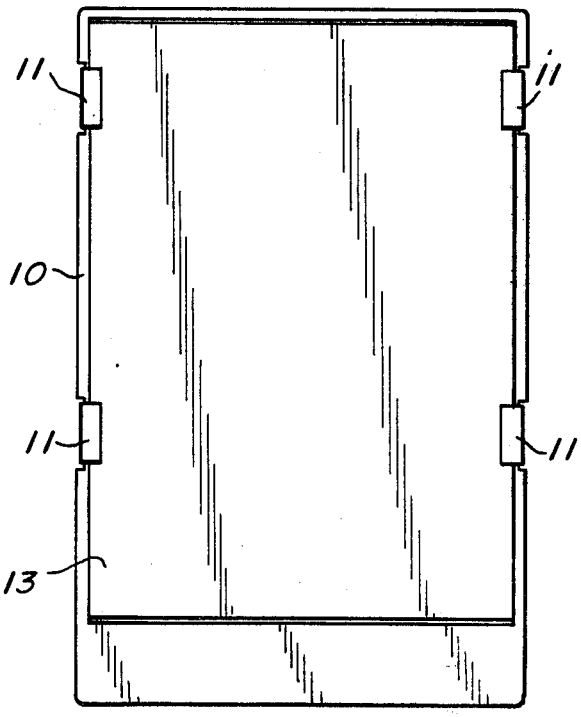
FIG. 3 shows a bottom view of the modular pushbutton keyset assembly of FIG. 1.

A side view of the modular pushbutton keyset assembly is shown in FIG. 2. In the preferred embodiment, two clips 11 are utilized on each side of the housing 10 to hold the assembly together. A bottom view of the assembly is shown in FIG. 3. The clips 11 are bent inwardly to provide a spring force which is applied to the circuit board 13 to hold the circuit board 13, the flat element 18 (see FIG. 4) and the pushbutton keys 12 in the housing 10. From the bottom of the assembly, the plurality of contact pairs on the circuit board 13 are readily accessible for interconnection at the edge of the circuit board 13.

Figure 4:
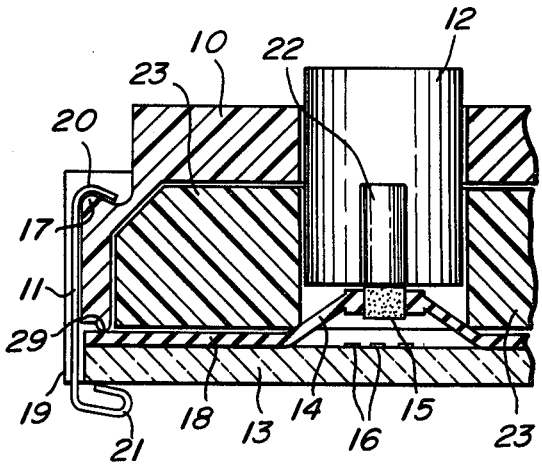
FIG. 4 is a fragmentary section taken substantially along the line 4—4 of FIG. 1.
Figure 5:
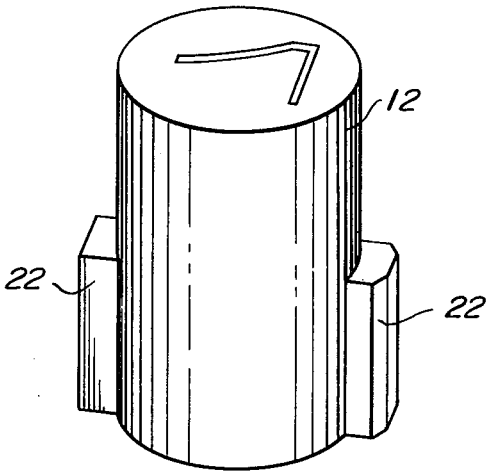
FIG. 5 is a perspective view of the pushbutton key showing the polarizing retention rib.
Figure 6A:
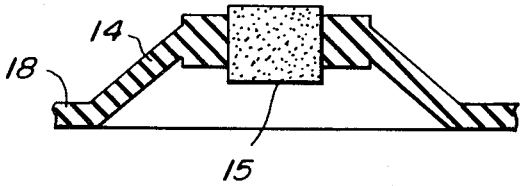
FIG. 6A is an enlarged view of the flat element and the popple of FIG. 4.
Figure 6B:
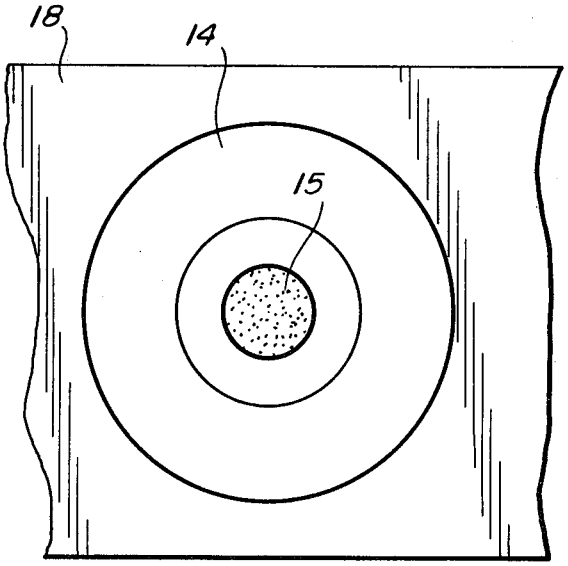
FIG. 6B is a bottom view of the flat element and popple of FIG. 6A.

The important features of the modular pushbutton keyset assembly can be more clearly apprehended from FIG. 4, which is a fragmentary section taken along the line 4—4 of FIG. 1. The clip 11 has a hooked first end 20 and an inwardly bent second end 21. The hooked first end 20 engages a tongue 17 of the housing 10, and the inwardly bent second end 21 applies a spring force to the circuit board 13 to hold the circuit board 13, the flat element 18 and the pushbutton keys 12 in the housing 10.

The flat element 18 includes a plurality of resilient popples 14 which are disposed to support corresponding pushbutton keys 12. Each of the popples 14 has a conductive underside 15. The pushbutton keys 12 include a rib 22 for both retaining the pushbutton key 12 in the housing 10 and polarizing the pushbutton key 12 such that the graphics on the top of the respective keys 12 are all oriented in the same direction.

The circuit board 13 includes an electrical contact pair 16 for each of the pushbutton keys 12. Each of the popples 14 has a conductive underside 15, which provides electrical continuity to a corresponding contact pair 16 when the respective pushbutton key 12 is depressed. The resilience of the popple 14 returns the pushbutton key 12 to its normal position and breaks the electrical continuity when the pushbutton key 12 is released.

The flat element 18 protects the surface of the circuit board 13 from contamination entering through the top of the housing 10 by a seal between a rib 29 on the housing 10 and the flat element 18 when the assembly is held together by the clips 11.

The modular pushbutton keyset assembly also includes an assembly 23 for illuminating the pushbutton keys 12 and the housing 10. The illumination assembly 23 is a light pipe assembly which evenly distributes the light rays from a single light source for uniformly illuminating the pushbutton keys 12 and the housing 10. The illumination assembly 23 is described in copending U.S. patent application, Ser. No. 799,055, entitled, "Illumination Apparatus For Use In A Illuminatable Pushbutton Keyset And The Like", by H. L. Schoemer and assigned to the same Assignee as the present application.

To prevent the circuit board 13 or the flat element 18 from slipping sideways, the housing 10 has a portion 19 which extends downward to contain the circuit board 13 and the flat element 18. Once assembled, the modular pushbutton keyset assembly can then be mounted in a particular device, in the preferred embodiment the handset of a telephone set, and appropriately interconnected with that device. Interconnect from the keyset assembly to the device is readily made by electrical contacts at the edge of the circuit board 13. The installed modular pushbutton keyset assembly can be subsequently removed and disassembled for repair or cleaning and then reassembled for an unlimited number of times without damage to any of the elements therein. Disassembly can be performed to change or replace pushbutton keys or to repair a faulty circuit board, a flat element with broken popples, a damaged housing or damaged pushbutton keys.

The features of the present invention can be more broadly applied to assemblies other than a pushbutton keyset. For example, a modular display assembly can advantageously utilize the principles of the present invention.

The foregoing embodiments have been intended as illustrations of the principles of the present invention. Accordingly, other embodiments, uses and applications can be devised by those skilled in the art without departing from the spirit and scope of the principles of the present invention.

What is claimed is:

1. A modular repairable pushbutton keyset assembly for mounting in, and interconnection with, a handset of a telephone set, said keyset assembly comprising:

a plurality of pushbutton keys each having at least one protruding rib;

a flat element including a plurality of resilient popples, raised portions of said popples being disposed to support corresponding ones of said plurality of pushbutton keys, each of saidpopples having a conductive underside;

a circuit board including a plurality of electrical contact pairs being disposed on the top surface thereof and opposite corresponding ones of said popples, each contact pair extending to the edge of the top surface of said circuit board for interconnection with the handset;

an outer housing having a protruding tongue and a protruding rib at the periphery, said outer housing engaging the protruding rib of said keys to retain and hold said plurality of keys in a predetermined spatial relationship with one another;

a light pipe assembly interposed between said outer housing and said flat element and circuit board for illuminating said keys and housing and urging said flat element against said circuit board; and a clip having a hooked first end and an inwardly bent second end, the hooked first end of said clip engaging the tongue in said housing, the inwardly bent second end of said clip providing a spring force to hold together said circuit board, said flat element, said light pipe assembly and said plurality of pushbutton keys in operative relationship, the inwardly bent second end of said clip further exerting a friction force against said circuit board along the edge of said inwardly bent second end spatially opposed to said circuit board for retaining said keyset assembly, and the protruding rib of said outer housing applying a concentrated compressive force to said flat element and said circuit board for providing a contamination resistant seal between said flat element and the top surface of said circuit board and between said housing and said flat element when said keyset assembly is held together.

2. The pushbutton keyset assembly according to claim 1, including a plurality of said clips; each having a hooked first end and an inwardly bent second end, said plurality of clips holding together said housing, said circuit board, said flat element and said plurality of pushbutton keys in operative relationship.

3. The pushbutton keyset assembly according to claim 1, wherein each of said pushbutton keys have graphics disposed on the top surface thereof and two opppositely disposed protruding ribs of the dissimilar shape for enabling the graphics of said keys to be unidirectionally oriented when said keys are held in said outer housing.

* * * * *